US007322428B2

(12) United States Patent
Bacila

(10) Patent No.: US 7,322,428 B2
(45) Date of Patent: Jan. 29, 2008

(54) VIBRATION REDUCTION APPARATUS FOR POWER TOOL AND POWER TOOL INCORPORATING SUCH APPARATUS

(75) Inventor: Dorin Bacila, Wiesbaden (DE)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 11/146,181

(22) Filed: Jun. 6, 2005

(65) Prior Publication Data

US 2005/0284646 A1 Dec. 29, 2005

(30) Foreign Application Priority Data

Jun. 5, 2004 (GB) ..... 0412619.9

(51) Int. Cl.
*B25D 17/24* (2006.01)

(52) U.S. Cl. ..... 173/162.2; 173/162.1; 16/431

(58) Field of Classification Search ..... 173/162.2, 173/161.1, 210, 211, 170, 162.1; 227/10; 16/430, 431
See application file for complete search history.

(56) References Cited

U.S. PATENT DOCUMENTS

| | | | | |
|---|---|---|---|---|
| 644,014 A | | 2/1900 | Jackson | |
| 1,358,486 A | | 11/1920 | Wilhelm | |
| 1,573,458 A | * | 2/1926 | Smith | 173/162.2 |
| 1,597,245 A | | 8/1926 | Prellwitz | |
| 1,644,030 A | * | 10/1927 | Prellwitz | 173/162.2 |
| 1,711,688 A | * | 5/1929 | O'Farrell | 173/162.2 |
| 2,290,256 A | * | 7/1942 | Souter | 173/121 |
| 2,349,341 A | * | 5/1944 | Disse | 72/466.5 |
| 3,451,492 A | | 6/1969 | Ekstrom et al. | |
| 3,788,404 A | | 1/1974 | Koudelka et al. | |
| 3,849,883 A | | 11/1974 | Kolorz | |
| 4,138,812 A | | 2/1979 | Zimmerer et al. | |
| 4,217,677 A | * | 8/1980 | Sumikawa | 16/431 |
| 4,282,938 A | | 8/1981 | Minamidate | |

(Continued)

FOREIGN PATENT DOCUMENTS

AT 122 752 5/1931

(Continued)

*Primary Examiner*—Scott A. Smith
(74) *Attorney, Agent, or Firm*—Michael P. Leary; Charles E. Yocum; Adan Ayala

(57) ABSTRACT

A handle assembly for a power tool is described and includes a first substantially tubular body portion 210 which contains a first spring 212. A second body portion 216 is slidably mounted within first body portion 210 and contains a second spring 218. A third body portion 222 is also slidably mounted within first body portion 210. The biasing coefficient, or spring constant, of the first spring 212 is less than that of the second spring 218. The first, second and third body portions 210, 216 and 222, and first and second springs, 212 and 218, are all mounted coaxially on threaded bolt 224. In use the third body portion 222 moves within first body portion 210 in a direction towards end portion 214 and the first and softer spring 212 becomes compressed more rapidly than the second and harder spring 218. When the distance $D^1$ has reduced to zero, by compression of first spring 212, the rubber washer 230 engages end portion 220 of second body portion 216 and the biasing effect of first spring 212 is eliminated The biasing force of the harder second spring 218 acts alone up to a distance $D^2$.

18 Claims, 3 Drawing Sheets

U.S. PATENT DOCUMENTS

| | | | | | |
|---|---|---|---|---|---|
| 4,371,043 | A | | 2/1983 | Kubokawa | |
| 4,401,167 | A | | 8/1983 | Sekizawa et al. | |
| 4,478,293 | A | | 10/1984 | Weilenmann et al. | |
| 4,611,671 | A | | 9/1986 | Hansson | |
| 4,673,043 | A | | 6/1987 | Greppmair | |
| 4,711,308 | A | | 12/1987 | Blass et al. | |
| 4,749,049 | A | | 6/1988 | Greppmair | |
| 4,800,965 | A | | 1/1989 | Keller | |
| 4,905,772 | A | | 3/1990 | Honsa et al. | |
| 4,936,394 | A | | 6/1990 | Ohtsu | |
| 5,025,870 | A | | 6/1991 | Gantner | |
| 5,046,566 | A | | 9/1991 | Dorner et al. | |
| 5,052,500 | A | | 10/1991 | Ohtsu | |
| 5,095,600 | A | | 3/1992 | Allan | |
| 5,125,189 | A | | 6/1992 | Holmin et al. | |
| 5,157,807 | A | | 10/1992 | Keller et al. | |
| 5,170,922 | A | * | 12/1992 | Ehmig et al. | 227/8 |
| 5,213,167 | A | | 5/1993 | Best et al. | |
| 5,269,381 | A | | 12/1993 | Oscarsson | |
| 5,363,736 | A | * | 11/1994 | Huang | 89/1.14 |
| 5,522,466 | A | | 6/1996 | Harada et al. | |
| 5,607,343 | A | | 3/1997 | Keith, Jr. et al. | |
| 5,697,456 | A | | 12/1997 | Radle et al. | |
| H1811 | H | | 11/1999 | Rescigno | |
| 6,123,158 | A | | 9/2000 | Steffen | |
| 6,148,930 | A | | 11/2000 | Berger et al. | |
| 6,375,171 | B1 | | 4/2002 | Zimmerman et al. | |
| 6,421,880 | B1 | | 7/2002 | Prajapati et al. | |
| 6,446,421 | B1 | | 9/2002 | Kramer et al. | |
| 6,766,868 | B2 | | 7/2004 | Frauhammer et al. | |
| 2001/0011846 | A1 | | 8/2001 | Krondorfer et al. | |
| 2002/0197939 | A1 | | 12/2002 | Frauhammer et al. | |
| 2003/0006051 | A1 | | 1/2003 | Schmitzer et al. | |

FOREIGN PATENT DOCUMENTS

| | | | |
|---|---|---|---|
| DE | 936 835 | | 12/1955 |
| DE | 1 143 397 | | 2/1963 |
| DE | 41 24 574 | A1 | 1/1993 |
| DE | 100 36 078 | A1 | 2/2002 |
| EP | 0 033 304 | A1 | 8/1981 |
| EP | 1 070 209 | | 1/2001 |
| EP | 1 514 648 | A2 | 3/2005 |
| GB | 080 920 | A | 2/1982 |
| GB | 2 243 571 | A | 11/1991 |
| GB | 2 297 514 | | 8/1996 |
| GB | 2 360 970 | A | 10/2001 |
| SU | 1269989 | A1 | 11/1986 |
| WO | WO 03057418 | | 7/2003 |

* cited by examiner

VIBRATION REDUCTION APPARATUS FOR POWER TOOL AND POWER TOOL INCORPORATING SUCH APPARATUS

FIELD OF THE INVENTION

The present invention relates to vibration reduction apparatus for power tools and to power tools incorporating such apparatus. The invention relates particularly, but not exclusively, to vibration reduction apparatus for power hammers, and to hammers incorporating such apparatus.

BACKGROUND OF THE INVENTION

Electrically driven hammers are known in which a driving member in the form of a flying mass is reciprocally driven by means of a piston, and impact of the flying mass against the end of the piston cylinder imparts a hammer action to a bit of the hammer. Such an arrangement is disclosed in European patent application EP1252976 and is shown in FIG. 1.

Referring in detail to FIG. 1, the prior art demolition hammer comprises an electric motor 2, a gear arrangement and a piston drive arrangement which are housed within a metal gear housing 5 surrounded by a plastic housing 4. A rear handle housing incorporating a rear handle 6 and a trigger switch arrangement 8 is fitted to the rear of the housings 4, 5. A cable (not shown) extends through a cable guide 10 and connects the motor to an external electricity supply. When the cable is connected to the electricity supply and the trigger switch arrangement 8 is depressed, the motor 2 is actuated to rotationally drive the armature of the motor. A radial fan 14 is fitted at one end of the armature and a pinion is formed at the opposite end of the armature so that when the motor is actuated the armature rotatingly drives the fan 14 and the pinion. The metal gear housing 5 is made from magnesium with steel inserts and rigidly supports the components housed within it.

The motor pinion rotatingly drives a first gear wheel of an intermediate gear arrangement which is rotatably mounted on a spindle, which spindle is mounted in an insert to the gear housing 5. The intermediate gear has a second gear wheel which rotatingly drives a drive gear. The drive gear is non-rotatably mounted on a drive spindle mounted within the gear housing 5. A crank plate 30 is non-rotatably mounted at the end of the drive spindle remote from the drive gear, the crank plate being formed with an eccentric bore for housing an eccentric crank pin 32. The crank pin 32 extends from the crank plate into a bore at the rearward end of a crank arm 34 so that the crank arm can pivot about the crank pin 32. The opposite forward end of the crank arm 34 is formed with a bore through which extends a trunnion pin 36 so that the crank arm 34 can pivot about the trunnion pin 36. The trunnion pin 36 is fitted to the rear of a piston 38 by fitting the ends of the trunnion pin 36 into receiving bores formed in a pair of opposing arms which extend to the rear of the piston 38. The piston is reciprocally mounted in cylindrical hollow spindle 40 so that it can reciprocate within the hollow spindle. An O-ring seal 42 is fitted in an annular recess formed in the periphery of the piston 38 so as to form an airtight seal between the piston 38 and the internal surface of the hollow spindle 40.

When the motor 2 is actuated, the armature pinion rotatingly drives the intermediate gear arrangement via the first gear wheel and the second gear wheel of the intermediate gear arrangement rotatingly drives the drive spindle via the drive gear. The drive spindle rotatingly drives the crank plate 30 and the crank arm arrangement comprising the crank pin 32, and the crank arm 34 and the trunnion pin 36 convert the rotational drive from the crank plate 30 to a reciprocating drive to the piston 38. In this way the piston 38 is reciprocatingly driven back and forth along the hollow spindle 40 when the motor is actuated by a user depressing the trigger switch 8.

The spindle 40 is mounted in magnesium casing 42 from the forward end until an annular rearward facing shoulder (not shown) on the exterior of the spindle abuts against a forward facing annular shoulder (not shown) formed from a set of ribs in the interior of the magnesium casing 42. The ribs enable air in the chamber surrounding the spindle 40 to circulate freely in the region between a ram 58 and a beat piece 64. An increased diameter portion on the exterior of the spindle fits closely within a reduced diameter portion on the interior of the magnesium casing 42. Rearwardly of the increased diameter portion and the reduced diameter portion an annular chamber is formed between the external surface of the spindle 40 and the internal surface of the magnesium casing 42. This chamber is open at its forward and rearward ends. At its forward end the chamber communicates via the spaces between the ribs in the magnesium casing with a volume of air between the ram 58 and the beat piece 64. At its rearward end the chamber communicates via the spaces between the ribs 7 and the recess of the gear casing 5 with a volume of air in the gear casing 5.

The volume of air in the gear casing 5 communicates with the air outside of the hammer via a narrow channel 9 and a filter 11. The air pressure within the hammer, which changes due to changes in the temperature of the hammer, is thus equalised with the air pressure outside of the hammer. The filter 11 also keeps the air within the hammer gear casing 5 relatively clean and dust free.

The ram 58 is located within the hollow spindle 40 forwardly of the piston 38 so that it can also reciprocate within the hollow spindle 40. An O-ring seal 60 is located in a recess formed around the periphery of the ram 58 so as to form an airtight seal between the ram 58 and the spindle 40. In the operating position of the ram 58 (shown in the upper half of FIG. 1), with the ram located behind bores 62 in the spindle, a closed air cushion is formed between the forward face of the piston 38 and the rearward face of the ram 58. Reciprocation of the piston 38 thus reciprocatingly drives the ram 58 via the closed air cushion. When the hammer enters idle mode (i.e. when the hammer bit is removed from a work piece), the ram 58 moves forwardly, past the bores 62 to the position shown in the bottom half of FIG. 1. This vents the air cushion and so the ram 58 is no longer reciprocatingly driven by the piston 38 in idle mode, as is known to persons skilled in the art.

Known hammer drills of this type suffer from the drawback that the hammer action generates significant vibrations, which can be harmful to users of the apparatus, and can cause damage to the apparatus itself.

Solutions to this problem have been proposed, for example, by including in devices of the type shown in FIG. 1 compression springs between one or both of the ends of handle 6 and the body of the device. An example of such a device is described in German patent application DE 10036078. One of the embodiments disclosed in DE 10036078 is shown in FIG. 2 of the present application, from which is can be seen that a power tool 100 has a handle 102 which is connected to a housing 104 at one end by a pivot 106 and at the other end by a damping mechanism 108. The damping mechanism 108 has a first spring 110 which is located within two apertures, 112 and 114, respectively set into the handle 102 and housing 104. First spring 110 can be compressed so that handle 102 comes into contact with housing 104 by closing space 116.

Damping mechanism 108 also has a second spring 120, which is stiffer than first spring 110. Second spring 120 at one end engages handle 102 and at its other end engages a cup shaped device 122. Cup 122 prevents spring 120 extending beyond the position shown in FIG. 2 by virtue of a rivet 124 which is at one end fixed to cup 122 and adjacent the other end slidably located within aperture 126.

In use power tool 100 is pushed by a user in direction 128 which causes handle 102 to move towards housing 104. This in turn causes the compression of first spring 110 and dampens vibrations which are caused by the hammer action of the power tool. As handle 102 moves towards housing 104 cup 122 also moves towards housing 104. Once handle 102 has moved through a distance indicated at 130, cup 122 becomes engaged with housing 104 and further movement of handle 102 towards housing 104 is opposed by both springs 110 and 120. Further movement of the handle is possible against the action of both springs 110 and 120 until gap 116 is closed at which point movement of the handle 102 is no longer dampened relative to the movement of the housing and all vibrations within the housing 104 are directly passed to the handle 102.

Dampening devices of this type suffer from the disadvantage that the transition from the dampening of a single spring to both springs is abrupt, causing additional vibration in the handle which must be absorbed by the user.

Preferred embodiments of the present invention seek to overcome problems with the prior art.

BRIEF SUMMARY OF THE INVENTION

According to an aspect of the present invention there is provided a handle assembly for a power tool, the assembly comprising:

at least one handle adapted to be held by a user of the power tool and to be mounted to a housing of the power tool such that at least one said handle is capable of movement relative to the housing between a respective first handle position, a respective second handle position and a respective third handle position, all measured relative to said housing;

at least one first biasing element for urging at least one said handle towards said first handle position therein, the or each said first biasing element having a first biasing coefficient; and at least one second biasing element for urging at least one said handle towards said first handle position, the or each said second biasing element having a second biasing coefficient, wherein said first biasing coefficient is less than said second biasing coefficient and wherein said first biasing element does not act on said handle between said second and third handle positions.

By providing a handle assembly with a damping device in which the hard and soft springs initially act together over a distance between a first position and a second position and then, upon reaching the second position, only the harder spring acts, the advantage is provided that the transition from softer biasing of the handle during the initial movements to the stiffer biasing between the second and third positions is smoother. This causes significant and surprising reductions in the discomfort felt by the user when compared to the damping devices of the prior art.

In a preferred embodiment at least one said first and/or second biasing element comprises at least one leaf spring.

In another preferred embodiment at least one said first and/or second biasing element comprises at least one torsion spring.

In a further preferred embodiment at least one first biasing element comprises at least one first helical spring and at least one second biasing element comprises at least one second helical spring.

At least one said first helical spring may be mounted substantially coaxially with at least one said second helical spring.

The assembly may further comprise at least one elongate member mounted substantially coaxially with at least one first biasing element and at least one second biasing element.

By mounting the helical springs substantially coaxially, the advantage is provided that the damping device is significantly more compact than the damping devices of the prior art. Furthermore, by mounting the springs substantially coaxially the effective spring constant $K_{total}$ of the pair of springs in use together is calculated by adding the spring constants $K_{soft}$, $K_{hard}$ of the individual springs in parallel as opposed to in series, as is the case in the prior art DE10036078. For example:

| Spring constant for both springs used in prior art DE10036078 | Spring constant for both springs used in present invention |
|---|---|
| $K_{total} = K_{soft} + K_{hard}$ | $\frac{1}{K_{total}} = \frac{1}{K_{soft}} + \frac{1}{K_{hard}}$ |

In a preferred embodiment, at least one said elongate member comprises at least one helical thread and is adapted to receive at least one respective cooperating threaded nut.

By mounting the two springs on a threaded nut and bolt, the advantage is provided that the nut and bolt can be used to adjust the tension in the springs and the amount of movement allowed by the damping mechanism.

The assembly may further comprise at least one stop for preventing further compression of at least one said first biasing member between said second and said third handle positions.

At least one said stop may comprise at least one annular member and may further comprise at least one resilient material.

By providing a resilient stop the advantage is provided that the transition from the user of one biasing element to the use of both biasing elements is further dampened, thereby further reducing the vibrations experienced by the user of the power tool.

The assembly may further comprise at least one first tubular body portion, at least one second body portion and at least one third body portion, wherein said first tubular body portion is adapted to receive said first biasing member, said second body portion is slidably received in said first body portion, said first tubular body portion is also adapted to receive said second biasing member and said third body portion is slidably received in said first body portion.

By situating the springs and body portions within a tubular body portion the advantage is provided that the handle is constrained to move linearly relative to the housing thereby reducing the likelihood of non-linear vibrations such as rocking of the handle relative to the housing.

The assembly may further comprise at least one said first and second biasing element connected at a first end of said handle and at least one said first and second biasing element connected at a second end of said handle.

According to another aspect of the present invention, there is provided a power tool comprising:

a housing;

a motor in the housing for actuating a working member of the tool; and a handle assembly as defined above.

BRIEF DESCRIPTION OF THE DRAWINGS

A preferred embodiment of the present invention will now be described, by way of example only, and not in any limitative sense, with reference to the accompanying drawings in which.

DETAILED DESCRIPTION OF THE INVENTION

Figure 1:
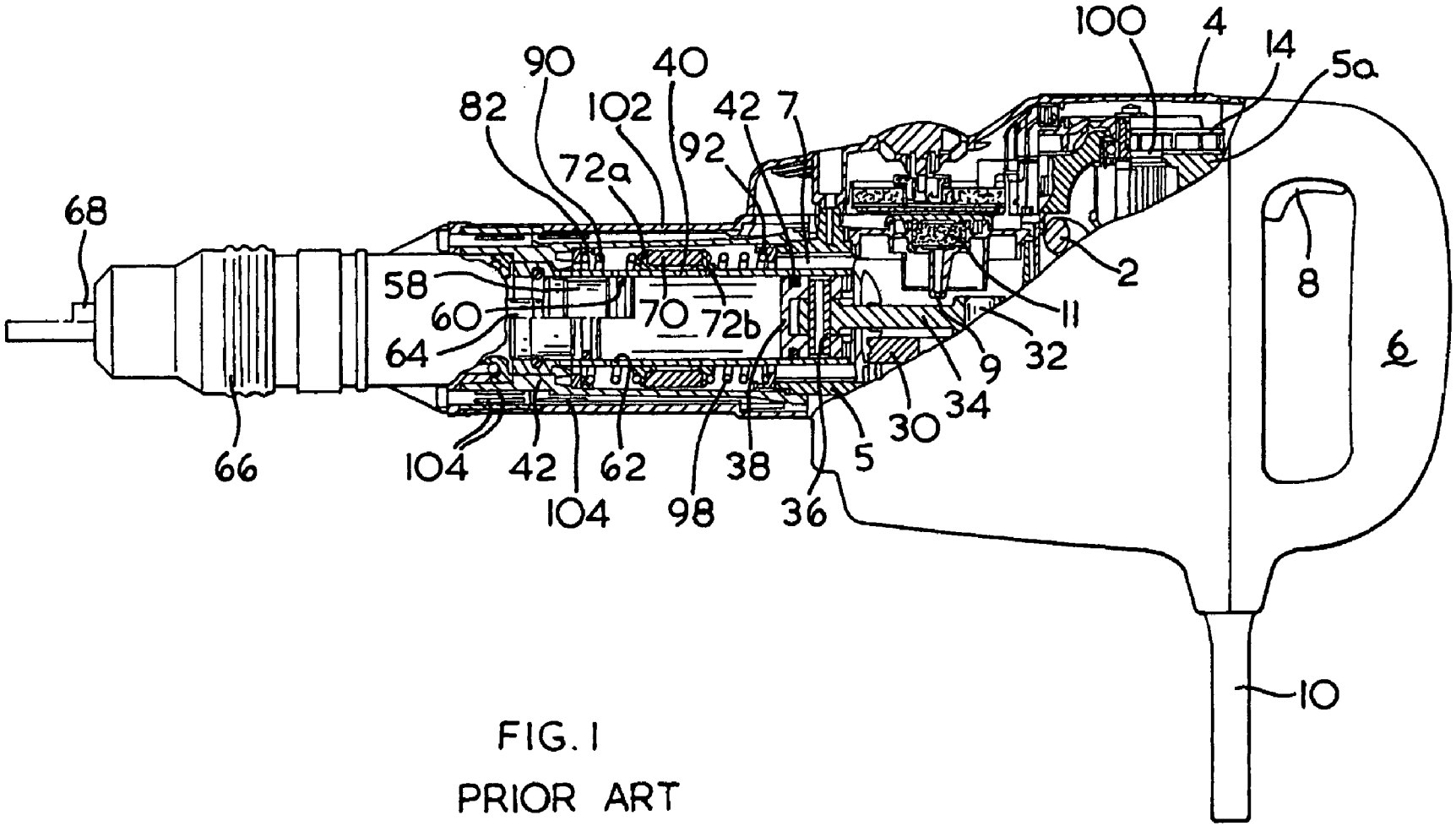
FIG. 1 PRIOR ART
FIG. 1 is a partial sectional view of a power tool of the prior art.
Figure 2:
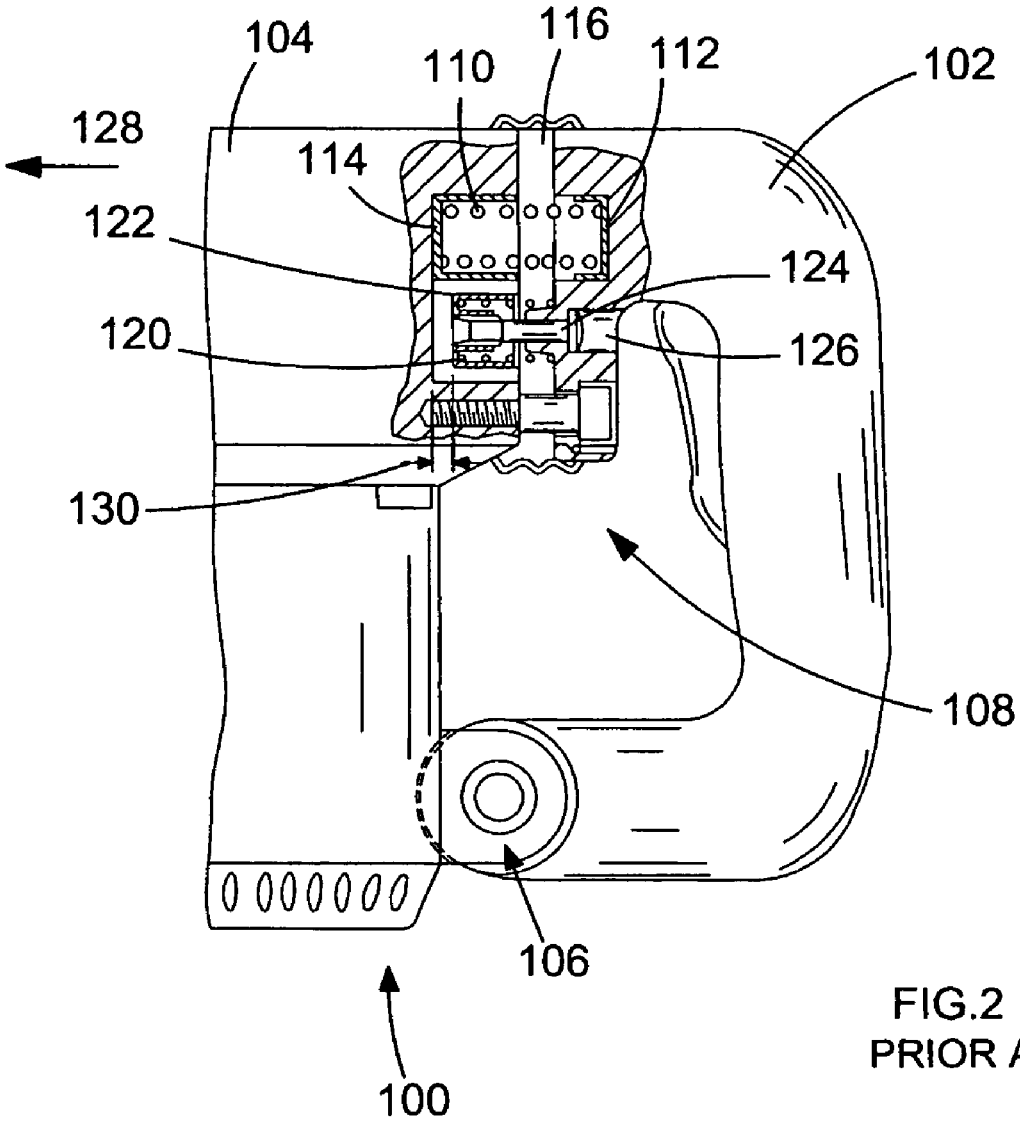
FIG.2 PRIOR ART
FIG. 2 is a partial sectional view of a handle assembly of the prior art.
Figure 3:
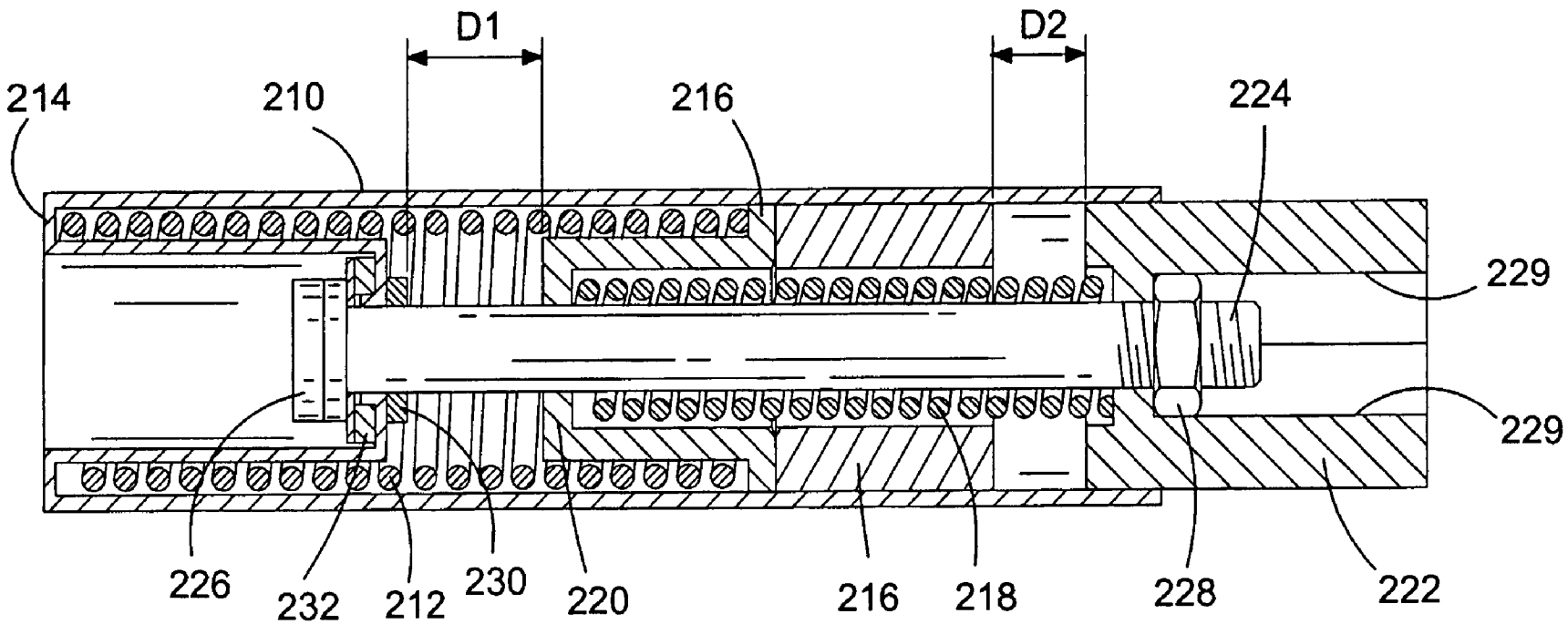
FIG. 3 is a sectional view of a part of a handle assembly of the present invention.

Referring to FIG. 3, a handle assembly for a power tool, for example a hammer or drill including a hammer action, includes a first substantially tubular body portion 210 which contains a first biasing element, first spring 212. First spring 212 is retained at one end by an end portion 214 of first body 210 and at the other end by second body portion 216 which is slidably mounted within first body portion 210. Second body portion 216 contains a second biasing element, second spring 218, which is retained at one end by end portion 220 of second body portion 216. The other end of second spring 218 is retained by third body portion 222. The biasing coefficient, or spring constant, of the first spring 212 is less than that of the second spring 218. This means that the first spring 212 is softer, and therefore more easily compressed, than the second spring 218.

The first, second and third body portions 210, 216 and 222, and first and second springs, 212 and 218, are all mounted coaxially on threaded bolt 224 and retained thereon at one end by head portion 226 of bolt 224 and at the other end by nut 228. The nut 228 is prevented from rotating within third body portion 222 by at least one flat surface 229 which engages one of the faces of nut 228. As a result any rotation of bolt 224 will cause nut 228 to travel along the threaded portion of bolt 224. If bolt 224 is rotated such that nut 228 is caused to move towards head 226 the first and second springs 212 and 218 become more compressed. This has the effect of appearing to the user to increase the rigidity of the damping mechanism thereby transferring more vibrations to the handle. This may be desirable in some situations where a very hard substance is being drilled into.

The biasing coefficient of the combined effect of the coaxially mounted springs, with a movable intermediate second body portion 216 between them, is calculated as the springs working in parallel. This is as opposed to the pair a springs acting in series as seen in the prior art DE 10036078. As a result the spring constant for an assembly when both springs are acting ($K_{total}$) is calculated from the spring constant of the first spring 212 ($K_{soft}$) and the spring constant of the second spring ($K_{hard}$) as follows:

| Spring constant for both springs used side by side (in series) | Spring constant for both springs used coaxially (in parallel) as in present invention |
|---|---|
| $K_{total} = K_{soft} + K_{hard}$ | $\frac{1}{K_{total}} = \frac{1}{K_{soft}} + \frac{1}{K_{hard}}$ |

It should be noted that if the springs are mounted coaxially but both ends of both springs act on the handle or housing, that is without an intermediate second body portion, the springs are acting in series and the spring constant $K_{total}$ is calculated accordingly.

The assembly is also provided with impact damping elements in the form of plastic or rubber washers 230 and 232.

First body portion 214 is connected to, or formed as part of, the housing 204 of the power tool in which the assembly is contained. The third body portion 222 is connected to, or formed as part of, the handle 202 of the same power tool. When in use the power tool is pressed against a surface such that the hammer action of the power tool is activated. The assembly allows for limited movement of the handle 202 relative to the housing 204 of the power tool. The second and third body portions 216 and 222, slide within the first body portion 210, and these movements are biased by the first and second springs 212 and 218.

The assembly as shown in FIG. 3 is in a first position in which the first and second springs 212 and 218 are fully extended as bound by the constraints of nut 228 and bolt 224. As the third body portion 222 moves within first body portion 210 in a direction towards end portion 214 the softer spring 212 becomes compressed more rapidly than the second and harder spring 218. In other words the distance D1, which extends from end portion 220 to rubber washer 230, decreases at a faster rate than the distance D2. When the distance D1 has reduced to zero, by compression of first spring 212, the rubber washer 230 engages end portion 220 of second body portion 216. Because washer 230 is made of rubber, or another similar resilient material, the impact of end portion 220 is slightly softened. Once distance D1 is reduced to is reduced to zero a second position has been reached and the biasing effect of first spring 212 is eliminated and the biasing force of the harder second spring 218 acts alone. This biasing force is able to act up to a distance D2, although as previously mentioned, distance D2 is slightly reduced by the time distance D1 is reduced to zero. When the distance D2 is reduced to zero a third position has been reached. In the third position there is no biasing of the handle relative to the housing. In other words, any vibrations occurring in the housing are directly transmitted through the three body portions 210, 216 and 222 directly to the handle.

It will be appreciated by persons skilled in the art that the above embodiment has been described by way of example only, and not in any limitative sense, and that various alterations and modifications are possible without the departure from the scope of the invention as defined by the appended claims. For example, other forms of biasing means may be used in alternative to the helical springs described above, such as leaf springs or torsion springs.

The invention claimed is:

1. A handle assembly for a power tool, the assembly comprising:

at least one handle adapted to be held by a user of the power tool and to be mounted to a housing of the power tool such that at least one said handle is capable of movement relative to the housing between a respective first handle position, a respective second handle position and a respective third handle position all measured relative to said housing;

at least one first biasing element for urging at least one said handle towards said first handle position thereof, the or each said first biasing element having a first biasing coefficient; and at least one second biasing element for urging at least one said handle towards said first handle position thereof, the or each said second biasing element having a second biasing coefficient, wherein said first biasing coefficient is less than said second biasing coefficient and wherein said first biasing element does not provide vibration isolation of said handle between said second and third handle positions.

2. A handle assembly according to claim 1, wherein at least one first biasing element comprises at least one first helical spring and at least one second biasing element comprises at least one second helical spring.

3. A handle assembly according to claim 2, wherein at least one said first helical spring is mounted substantially coaxially with at least one said second helical spring.

4. A handle assembly according to claim 1, further comprising at least one elongate member mounted substantially coaxially with at least one first biasing element and at least one second biasing element.

5. A handle assembly according to claim 4, wherein at least one said elongate member comprises at least one helical thread and is adapted to receive at least one respective cooperating threaded nut.

6. A handle assembly according to claim 1, further comprising at least one stop for preventing further compression of at least one said first biasing member between said second and said third handle positions.

7. A handle assembly according to claim 6, wherein at least one said stop comprises at least one annular member.

8. A handle assembly according to claim 6, wherein at least one said stop comprises at least one resilient material.

9. A handle assembly according to claim 1, further comprising at least one first tubular body portion at least one second body portion and at least one third body portion, wherein said first tubular body portion is adapted to receive said first biasing member, said second body portion is slidably received in said first body portion, said first tubular body portion is also adapted to receive said second biasing member and said third body portion is slidably received in said first body portion.

10. A power tool comprising:

a housing;

at least one handle adapted to be held by a user of the power tool and to be mounted to a housing of the power tool such that at least one said handle is capable of movement relative to the housing between a respective first handle position, a respective second handle position and a respective third handle position all measured relative to said housing;

at least one first biasing element for urging at least one said handle towards said first handle position thereof, the or each said first biasing element having a first biasing coefficient; and at least one second biasing element for urging at least one said handle towards said first handle position thereof, the or each said second biasing element having a second biasing coefficient, wherein said first biasing coefficient is less than said second biasing coefficient and wherein said first biasing element does not provide vibration isolation of said handle between said second and third handle positions.

11. A handle assembly for connecting a vibration isolated handle from the housing of a power tool, the assembly comprising:

a first body portion secured to the tool housing;

a second body portion secured to the handle;

an intermediate body portion movably mounted between the first body portion and second body portion;

a first spring having a first spring coefficient and connected between the first body portion and the intermediated body portion so as to bias the intermediate body portion away from the tool housing;

a second spring having a second spring coefficient and connected between the intermediate body portion and the second body portion so as to bias the second body portion away from the intermediate body portion; and wherein, as forces compressing the first and second spring increase, the handle assembly moves from a first condition to a second condition, and in the first condition the first spring and the second spring are each at a respective minimum state of compression, and in the second condition the first spring is at a maximum state of compression such that the intermediate body portion is in direct vibration transmitting contact with the first body portion.

12. The handle assembly of claim 11 wherein the first body portion defines an interior bore and the intermediate body portion is slidably mounted within the bore of the first body portion.

13. The handle assembly of claim 12 wherein the first spring is located within the bore of the first body portion.

14. The handle assembly of claim 12 further comprising a rod defining an axis and located coaxially within the bore of the first body portion and the intermediate body portion is slidably mounted around the rod for axial movement relative to the first body portion.

15. A power tool comprising:

a tool housing;

a hammer mechanism located in the housing and acting along a longitudinal axis;

a handle;

a connecting assembly connected between the tool housing and the handle for substantially isolating the handle from longitudinal vibrations generated in the housing by the hammer mechanism, the connecting assembly including;

a first body fixed to the tool housing without substantial axial freedom of movement relative thereto, the first body defining an axis of compression;

an intermediate body axially movable relative to the first body along the axis of compression;

a first spring having a first spring coefficient and acting so as to create a first axial separation between the first body and the intermediated body;

a second body fixed to the handle and axially movable relative to the first body and the intermediate body along the axis of compression;

a second spring having a second spring coefficient and acting so as to create a second axial separation between the intermediate body and the second body; and wherein, as operational forces compressing the first and second spring increase, the handle assembly moves from a first condition to a second condition, and in the first condition the first spring and the second spring are each at a respective minimum state of compression, and in the second condition the first spring is at a maximum state of compression such that the intermediate body is in direct axial contact with the first body.

16. A power tool according to claim 15 wherein the first spring coefficient is less than the second spring coefficient.

17. A power tool according to claim 16 wherein under compressive loading the first axial separation decreases faster than the second axial separation.

18. A power tool according to claim 17 wherein under compressive loading the first axial separation closes before the second axial separation.

* * * * *